US006663106B1

(12) United States Patent
Cosmi

(10) Patent No.: US 6,663,106 B1
(45) Date of Patent: Dec. 16, 2003

(54) ROULETTE OF IMPROVED TYPE AND NEW GAMBLING GAME PROVIDING FOR THE USE OF SAID IMPROVED ROULETTE

(76) Inventor: Giuseppe Cosmi, Via Negroli 23, 20133 Milan (IT)

( * ) Notice: Subject to any disclaimer, the term of this patent is extended or adjusted under 35 U.S.C. 154(b) by 0 days.

(21) Appl. No.: 09/685,916

(22) Filed: Oct. 10, 2000

Related U.S. Application Data

(62) Division of application No. 09/144,712, filed on Sep. 1, 1998, now Pat. No. 6,227,542.

(30) Foreign Application Priority Data

Apr. 9, 1998 (IT) ..... VR98A0026

(51) Int. Cl.[7] ..... A63F 5/04

(52) U.S. Cl. ..... 273/142 E; 273/142 HA; 273/274

(58) Field of Search ..... 273/142 E, 142 F, 273/142 G, 142 H, 142 HA, 274

(56) References Cited

U.S. PATENT DOCUMENTS 1,468,984 A * 8/1923 Weaver
1,578,412 A * 3/1926 Ewig
4,193,213 A * 3/1980 Suda
5,102,135 A * 4/1992 Addiechi
5,437,452 A * 8/1995 Graf
5,636,838 A * 6/1997 Caro
6,217,022 B1 * 4/2001 Astaneha

FOREIGN PATENT DOCUMENTS

| | | |
|---|---|---|
| EP | 0 714 683 | * 11/1995 |
| GB | 2304295 | * 3/1997 |
| JP | 411137772 | * 5/1999 |
| WO | WO-98/07482 | * 2/1998 |

* cited by examiner

*Primary Examiner*—William M. Pierce

(57) ABSTRACT

It is described a roulette of a new type including two bowls coaxial to each other and rotating around the same axis and two small balls, each ball rolling around one of the bowls, where on each bowl are engraved data which refer to an independent event.

On a first embodiment, the two independent events are:

the signs of the zodiac, the numbers from 0 to 31, where the signs of the zodiac are preferably engraved on the external, ring-shaped bowl, while the numbers from 0 to 31 are preferably engraved on the internal bowl.

On a second embodiment, the events engraved on the two bowls are related to one or more of the calendars used in Asiatic countries (China, Korea, Japan and so on).

Furthermore, a new gambling game providing for the use of said improved roulette is described.

2 Claims, 3 Drawing Sheets

ROULETTE OF IMPROVED TYPE AND NEW GAMBLING GAME PROVIDING FOR THE USE OF SAID IMPROVED ROULETTE

The present application is a divisional application Ser. No. 09/144,712, filed Sep. 1, 1998 now U.S. Pat. No. 6,227,542.

DESCRIPTION OF THE INVENTION

The present invention refers to a roulette of a new type including two bowls coaxial to each other and rotating around the same axis and two balls, each of which rolls around one of the bowls: on each bowl are engraved data referring to an independent event to increase the amount of possible combinations. Furthermore, the present invention refers to a new gambling game providing for the use of said improved roulette.

PRIOR ART

It is well known that the word "roulette" refers both to a gambling game played by rolling a small ball around a shallow bowl with an inner disk revolving in the opposite direction and provided with a plurality of numbered compartments wherein the ball comes to rest, and to the above described gambling apparatus (shallow bowl, ball, and so on).

The already known roulettes provide for 37 or 38 numbered compartments, 36 of which provide (or could provide) for winning combinations for the players. The rules providing the ratio between each winning combination and the bet(s) of the winning player(s) are already known.

An object of the present invention is to increase the amount of possible combinations by combining two events independent to each other. A further object of the present invention is to realize an improved roulette which includes two independent bowls rotating around the same axis and two balls, on each of said bowls being engraved data referring to one of said independent events.

Furthermore, an object of the present invention is a new gambling game providing for the use of said improved roulette.

BRIEF DESCRIPTION OF DRAWINGS

The present invention will be now disclosed with reference to not limiting embodiments shown by the enclosed sheets of drawings, where.

DETAILED DESCRIPTION OF THE INVENTION

Figure 1:
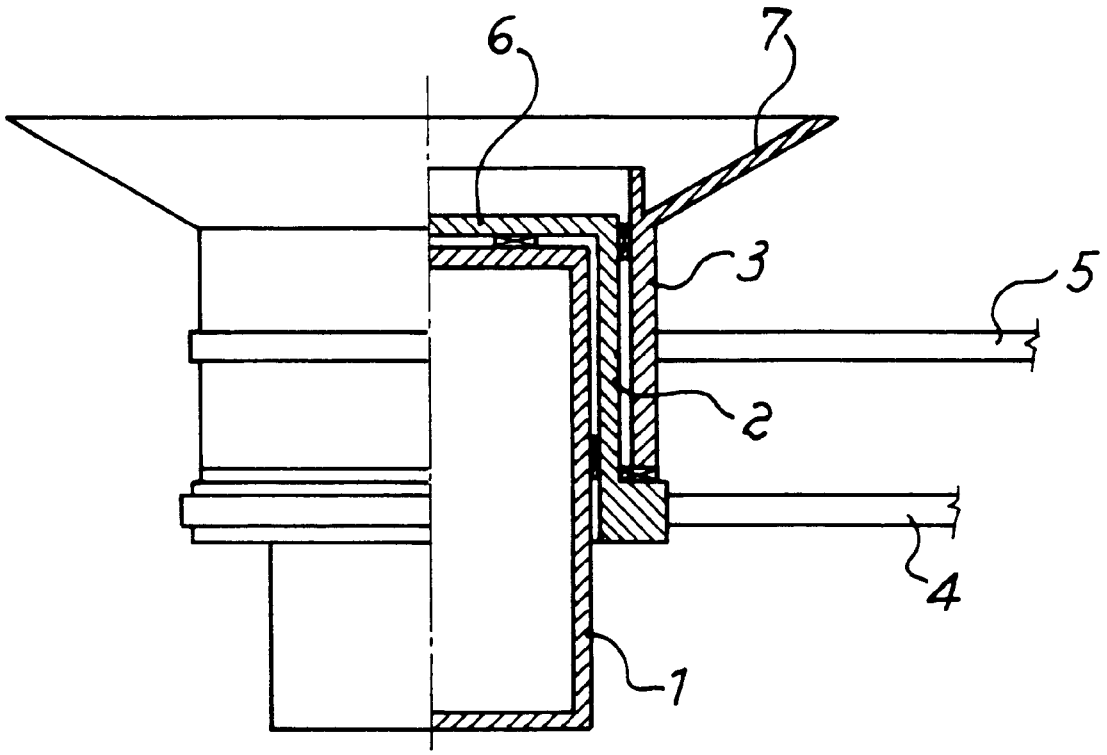
FIG. 1 shows schematically a side view, partially sectioned, of an improved roulette realized according to the present invention.

FIG. 1 shows schematically a side view, partially sectioned, of an improved roulette (realized according to the present invention) which includes two bowls coaxial to each other and rotating around the same axis and two balls, each of which rolls around one of the bowls in the opposite direction with respect to the relevant bowl; on each bowl are engraved data referring to an independent event. Said roulette includes:

a cylindrical base 1;

a first cylindrical body 2, mounted on the cylindrical base 1, the upper side of the first cylindrical body 2 supporting the internal bowl 6 on which (according to the first embodiment shown by FIG. 2) the numbers from 0 to 31 are engraved;

a second cylindrical body 3, mounted on the first cylindrical body 2, the upper side of the second cylindrical body 3 supporting the external, ring-shaped bowl 7 on which (according to the first embodiment shown by FIG. 2) the signs of the zodiac are engraved;

a first and a second ball, suitable for rolling around the internal, respectively around the external bowl, said balls being not shown in the figures for simplicity of graphical representation sake;

moving means (4, 5), suitable to move in an independent way the first and the second cylindrical body (2, 3);

antifriction means (realized through bearings and/or through other mechanical equivalent means) positioned between the cylindrical base 1 and the first cylindrical body 2 and, respectively, between the first cylindrical body 2 and the second cylindrical body 3; said antifriction means will not be described in detail as they are well known to any person skilled in the art and, in any case, their specific embodiment(s) would depart from the scope of the present invention.

On a preferred embodiment (described therein) the internal bowl 6 is quite flat while the external, ring-shaped bowl 7 is flared but, without departing from the scope of the present invention, both bowls could be quite flat or more or less flared.

Figure 2:
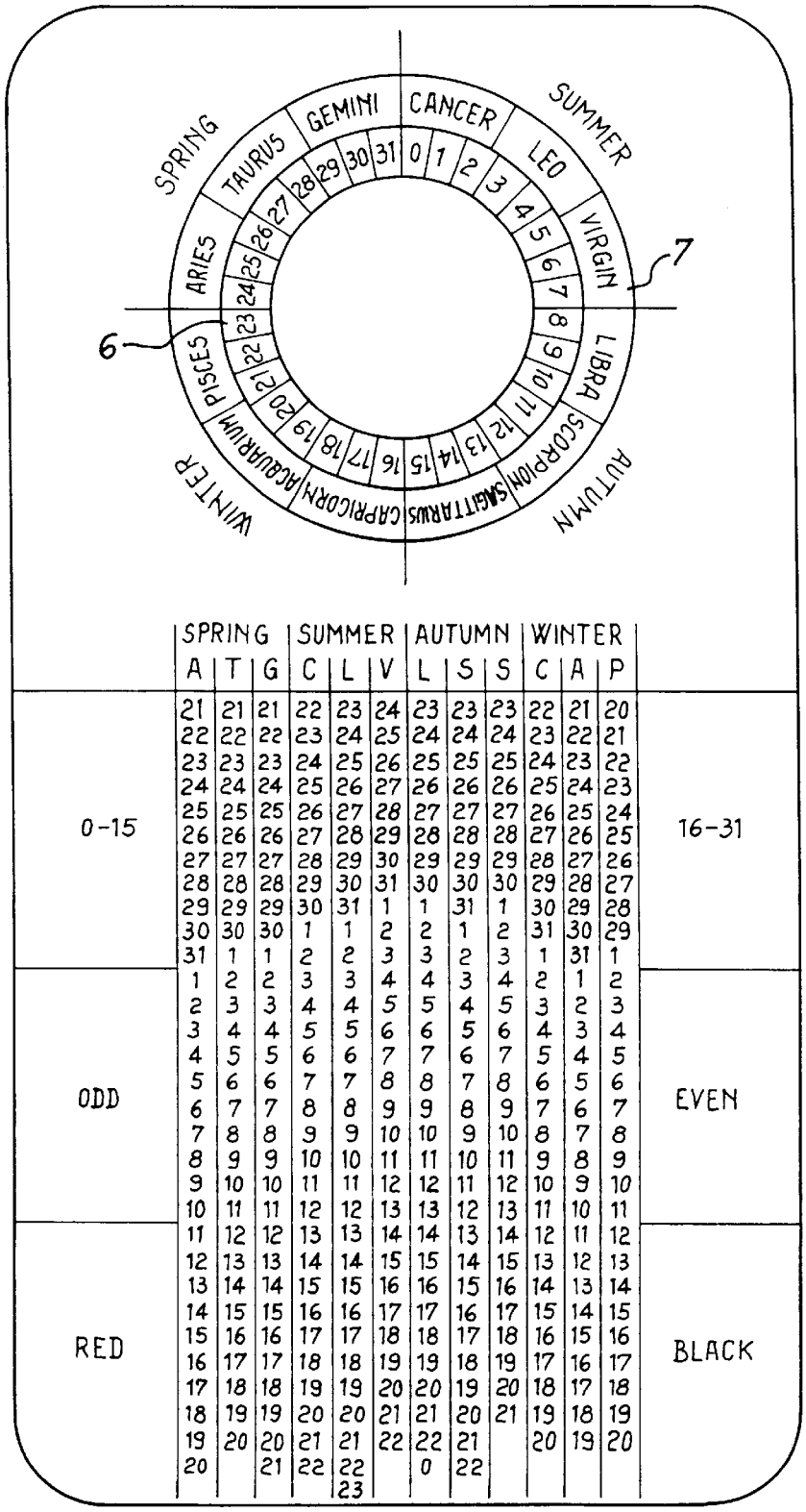
FIG. 2 shows a top view of a first embodiment of the improved roulette of FIG. 1 and of the relevant playing baize.
Figure 3:
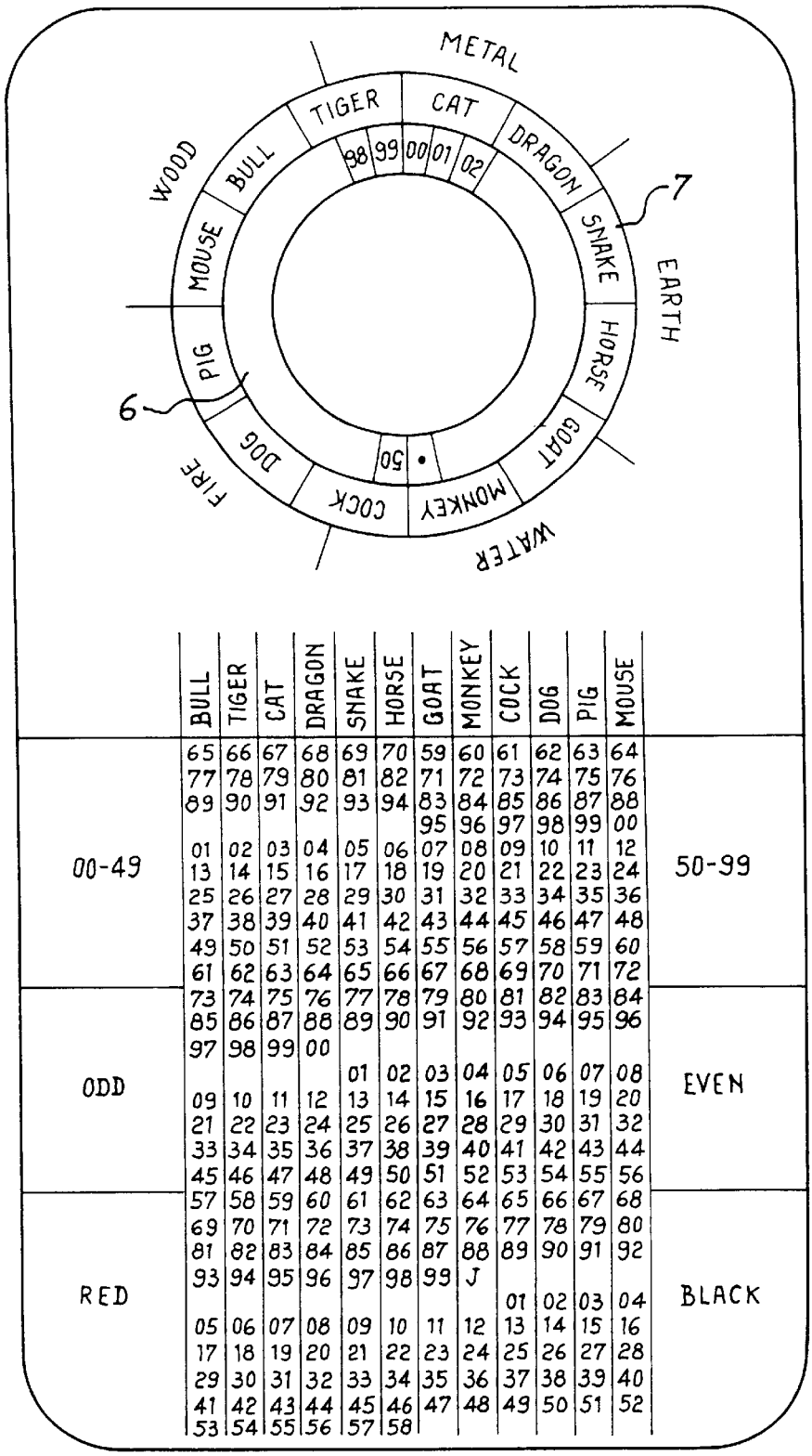
FIG. 3 shows a top view of a second embodiment of the improved roulette of FIG. 1 and of the relevant playing baize.

As will be better appreciated with reference to the top views of FIGS. 2 and 3, the two bowls (and in particular the internal one) are very large and heavy as they must be so strong and stiff to avoid any risk of deformation(s): it is therefore (quite) impossible (and, in any case, very difficult) to move by hand (as occurs with already known roulettes) both the bowls at the same time. In addition, the two bowls are normally very different in weight to each other and their inertia are therefore very different.

In view of the above, the improved roulette normally includes moving means, which are preferably made up by a pair of motors (not shown in FIG. 1 and activated by an operator through a switch or through another equivalent means), each of which rotates through a belt (or through another coupling means, already known) one of the bowls.

Preferably but not necessarily, the two bowls revolve in opposite directions.

By using a pair of motors, the independence of the two bowls (and, as a consequence, the independence of the two events to which the data engraved on the bowls refer) is improved but, without departing from the scope of the invention, only one motor rotating both bowls could be provided.

The rotation speeds of the two bowls are preferably the same and, in any case, their difference does not exceed 10%.

As shown in FIG. 1, the inner edge of the external, ring-shaped bowl 7 is a raised edge to avoid any risk that the ball rolling around the inner bowl 6 could jump on the external bowl 7 and/or vice-versa or at least to reduce the jumping probability. Always with the aim of avoiding that the balls can jump, on the preferred embodiment described therein the two bowls (6, 7) are magnetized in opposite ways and each of the balls is magnetized in opposite way with respect to the bowl around which it rolls: if the magnetization of the internal bowl 6 is positive, the magnetization of the ball rolling on the internal bowl 6 and that of the external bowl 7 are negative and the magnetization of the ball rolling on the external bowl 7 is positive and vice-versa (if the magnetization of the internal bowl 6 is negative, the magnetization of the ball rolling on the internal bowl 6 and that of the external bowl 7 are positive and the magnetization of the ball rolling on the external bowl 7 is negative). Of course, the attraction force between a bowl and the relevant ball is suitable to maintain the ball into the relevant bowl, but it is not so high to reduce the randomness of the relevant event by interfering with the free rolling of the ball around the relevant bowl.

The balls and the bowls are (or can be) magnetized by known ways, not shown in the figures and not described for sake of simplicity: for example, the balls are (or can be) magnetized by providing a core of permanent magnetic material, while the bowls are (or can be) magnetized by including therein pieces of a permanent magnetic material or by providing one or more electrical winding(s) suitable to generate one or more uniform magnetic field(s) and power supplied (for example, through one or more pair(s) of sliding contacts) by one or more generator(s) of a direct current.

According to the embodiments shown by FIGS. 2 and 3. the internal bowl 6 and the external bowl 7 are provided with a plurality of seats which are so flat at not to be interfering with the free rolling of the relevant ball around the internal bowl 6, respectively around the external bowl 7, but the ball comes to rest in one of said seats: on the embodiment shown by FIG. 2 each of the numbers from 0 to 31, respectively each sign of the zodiac is engraved inside one of said seats.

As set forth above, the inertia of the two bowls are normally very different and their stop times are (or can be) therefore very different: to speed up the game by reducing the time between two bets running (which depends on the higher stop time), braking means acting on the bowl (generally the internal bowl 6) providing for the higher stop time are (or can be) provided.

The braking means are (or could be) mechanical, electrical or of any type already known and will not be described in detail as they are well known to any person skilled in the art and, in any case, their specific embodiment(s) would depart from the scope of the present invention.

The braking means could be activated automatically through the same switch (or equivalent means) which activates for a first preset time the motor(s), waits for a preset delay and then activates for a second preset time the braking means. FIG. 2 shows a top view of a first embodiment of the improved roulette of FIG. 1 and of the relevant playing baize.

On the external bowl 7 the signs of the zodiac are engraved, while on the internal bowl 6 the numbers from 0 to 31 are engraved, as in a traditional roulette. The seats of the two bowls wherein the signs of the zodiac and the dates are respectively engraved are alternatively colored by two different colors that, in the present embodiment, are black and red: without departing from the scope of the invention, two different colors (for example green and yellow) can be used. The four seasons are printed on the playing baize around the external bowl 7 of the roulette; furthermore, the four seasons, the first letter of the names of the signs of the zodiac and the numbers corresponding to the dates belonging to each sign of the zodiac, positioned by column under the first letter of the name of the relevant sign of the zodiac, are printed on the playing baize, where there are printed further boxes labeled as in the known roulette playing baize (odd, even; red, black; etc.).

According to a further embodiment, not shown in the drawings, on the internal bowl 6 the numbers from 0 to 31 are replaced by twelve groups of dates, each of which corresponds to one of the signs of the zodiac.

FIG. 3 shows a top view of a second embodiment of the improved roulette of FIG. 1 and of the relevant playing baize, whose most relevant difference with respect to the first embodiment shown by FIG. 2 is that the independent events engraved on the two bowls are related to the traditional Chinese calendar and horoscope instead of to the signs of the zodiac. The Chinese calendar is based on 5 cycles of 12 years, where each year of each cycle is related to an animal and each cycle is related to an element (metal, hearth, water, fire and wood): to increase the amount of possible combinations, five of said cycles (corresponding to an enlarged period of 300 years) are considered on the present improved roulette.

On the external bowl 7 the names of the 12 animals are engraved, while on the internal bowl 6 at least one hundred groups of numbers, each of which is corresponding to the last two digits (from 00 to 99) of a year are engraved. In FIG. 3 only some of said group of numbers are shown for simplicity of graphical representation sake; without departing from the scope of the invention, further groups of numbers (as, for example, a second "00" or a "jolly" shown in FIG. 3 as ".") could be engraved on the internal bowl 6.

The seats of the two bowls wherein the names of the animals and the year's last digits are respectively engraved are alternatively colored by two different colors that, in the present embodiment, are black and red: without departing from the scope of the invention, two different colors (for example yellow and green) can be used.

Furthermore, the names of the animals and the year's last digits, positioned by column under the name of the relevant animal, are printed on the playing baize, where there are printed further boxes labeled as in the known roulette playing baize (odd, even; red, black).

A further object of the present invention is a new gambling game providing for the use of one of the improved roulettes described above.

The most important rules of said new gambling game providing the ratio between a bet and each winning combination of a number (or of a date) engraved on the internal bowl 6, of a sign of the zodiac engraved on the external bowl 7 and of one of the four seasons (printed on the playing baize around the external bowl and identified by the seat on which the ball rolling on the external bowl 7 rests) will be now described with reference to the roulette and to the playing baize shown by FIG. 2.

By making a bet on the playing baize of FIG. 2, a player bets at the same time on at least a number (or on at least a date), on a sign of the zodiac and on a season. If the number (or the date) [but neither the season nor the sign of the zodiac] is drawn, the player wins 24 times the bet; if the number (or the date) and the sign of the zodiac are drawn, the player wins 36 times the bet; if the number (or the date) and the season are drawn, the player wins 48 times the bet.

If the player bets on two adjacent numbers (or dates) belonging to the same column and one of said numbers (or dates) [but neither the season nor the sign of the zodiac] is drawn, the player wins 12 times the bet; if one of said numbers (or dates) and the season (but not the sign of the zodiac) are drawn, the player wins 18 times the bet; if one of said numbers (or dates) and the sign of the zodiac are drawn, the player wins 24 times the bet.

If the player bets on three adjacent numbers (or dates) belonging to the same column and one of said numbers (or dates) [but neither the season nor the sign of the zodiac] is drawn, the player wins 6 times the bet; if one of said numbers (or dates) and the season (but not the sign of the zodiac) are drawn, the player wins 9 times the bet; if one of said numbers (or dates) and the sign of the zodiac are drawn, the player wins 12 times the bet.

Other ratios between the bets and the wins are:

a vertical column of numbers (or dates): 2 times the bet;

two adjacent vertical columns of numbers (or dates): 0,5 times the bet;

odd or even, red or black, etc.: 0,5 times the bet.

Furthermore, a special winning combination (Jackpot) is (or can be) provided: if a player betting on the number (or the date) which is drawn can demonstrate that both the drawn number (or date) and the drawn sign of the zodiac are corresponding to those of his birthday, he receives an extra win, for example 1 Million Dollars.

Of course, the above winning ratios and/or the Jackpot have been indicated only as examples and can be omitted and/or modified without departing from the scope of the present invention.

With reference to the roulette and to the playing baize shown by FIG. 3, the ratio between a bet and each winning combination of a year's last two digits engraved the internal bowl 6, of the name of an animal engraved on the external bowl 7 and of an element (printed on the playing baize around the external bowl 7) will be now described As only the names of the animals and the year's last digits, positioned by column under the name of the relevant animal, are printed on the playing baize, to allow a player to bet on an element five sets of chips, each of which corresponds to one of said elements, are provided.

By making a bet on the playing baize of FIG. 3 through one of said chips, a player bets at the same time on a year's last two digits, on the name of an animal and on an element.

If the year's last two digits (but neither the element nor the name of an animal) are drawn, the player wins 24 times the bet; if the year's last two digits and the element (but not the name of an animal) are drawn, the player wins 36 times the bet; if the year's last two digits and the name of an animal are drawn, the player wins 48 times the bet.

If the player bets on two adjacent year's last two digits belonging to the same column and one of said year's last two digits (but neither the element nor the name of an animal) is drawn, the player wins 12 times the bet; if one of said year's last two digits and the element (but not the name of an animal) are drawn, the player wins 18 times the bet; if one of said year's last two digits and the name of an animal are drawn, the player wins 24 times the bet.

If the player bets on three adjacent year's last two digits belonging to the same column and one of said year's last two digits (but neither the element nor the name of an animal) are drawn, the player wins 6 times the bet; if one of said year's last two digits and the element (but not the name of an animal) are drawn, the player wins 9 times the bet; if one of said year's last two digits and the name of an animal are drawn, the player wins 12 times the bet.

Other ratios between the bets and the wins are:

a vertical column of year's last two digits: 3 times the bet;

two adjacent vertical columns of year's last two digits: 2 times the bet;

three adjacent vertical columns of year's last two digits: 0,5 times the bet;

odd or even, red or black, etc.: 1 times the bet.

Of course, the above winning rates have been indicated only as examples and can be omitted and/or modified without departing from the scope of the present invention.

Finally, in view of the ever increasing importance and use of electronic devices and of computer controlled systems, a computerized embodiment of the above described new gambling game(s) can be realized, e.g. through a "web site" of "Internet" and/or by replacing the playing baize with a plurality or playing terminals, each of which includes (or can include) at least a display showing (for example) the playing baize and/or playing instructions and/or other messages, a keyboard for inputting the bet(s) and means (a badge unit, a credit card unit and so on) for debiting the bet(s) and for crediting the win(s), if any.

On the not limiting embodiments shown in FIGS. 2 and 3, the English language and Roman characters have been used, but a different language (for example Russian, Greek, Arabic and so on) and/or different characters and alphabets (for example Cyrillic, Greek, Arabic ones), including ideograms used in Chinese and in other oriental languages, can be used without departing from the scope of the invention.

What is claimed is:

1. Device for playing a gambling game comprising a roulette and a playing baize, the roulette including at least a first ball and a second ball, an internal bowl and an external bowl, the internal and the external bowl being coaxial to each other and rotating around a common axis, wherein:

said first ball is adapted to roll around the internal bowl and said second ball is adapted to roll around the external bowl;

each of said bowls having a plurality of seats in which a ball may reside, each of said seats being engraved with a zodiac sign and numbers from 0 to 31;

said playing baize being printed with said zodiac signs and said numbers, said numbers being positioned at an upper place under said zodiac signs with the numbers corresponding to the first date of each zodiac sign; and said playing blaize having the names of four seasons, the zodiac signs and numbers from 0 to 31 printed thereon.

2. Device for playing a gambling game comprising a roulette and a playing baize, the roulette including at least a first ball and a second ball, an internal bowl and an external bowl, the internal and the external bowl being coaxial to each other and rotating around a common axis, wherein:

said first ball is adapted to roll around the internal bowl and said second ball is adapted to roll around the external bowl;

each of said bowls having a plurality of seats in which a ball may reside, each of said seats being engraved with animals names consisting of bull, tiger, cat, dragon, snake, horse, goat, monkey, cock, dog, pig and mouse, said seats also being engraved with two digits corresponding to the last two digits of a calendar year;

said playing blaize having the names of said animals and said two digits corresponding to the last two digits of a calendar year, said two digits corresponding to the years being positioned by column under the names of said animals;

said playing blaize also having printed thereon five elements corresponding to wood, metal, earth, water and fire; and five sets of betting chips which correspond to one of said five elements.

* * * * *